US006093453A

United States Patent [19]

Ang

[11] Patent Number: 6,093,453

[45] Date of Patent: Jul. 25, 2000

[54] ELECTROLESS PLATING METHOD

[75] Inventor: Jane Ang, San Mateo, Calif.

[73] Assignee: Aiwa Co., Ltd., Tokyo, Japan

[21] Appl. No.: 09/310,884

[22] Filed: May 17, 1999

Related U.S. Application Data

[62] Division of application No. 08/546,389, Oct. 20, 1995, Pat. No. 5,938,845.

[51] Int. Cl.[7] ..... B05D 1/18

[52] U.S. Cl. ..... 427/438; 427/437; 427/443.1; 427/443.2; 118/429

[58] Field of Search ..... 427/443.1, 437, 427/438, 443.2; 118/429

[56] References Cited

U.S. PATENT DOCUMENTS

| | | | |
|---|---|---|---|
| 2,658,839 | 11/1953 | Talmey et al. . | |
| 2,791,516 | 5/1957 | Chambers et al. . | |
| 3,385,725 | 5/1968 | Schmeckenbecher | 427/438 |
| 3,876,434 | 4/1975 | Dutkewych et al. . | |
| 4,074,733 | 2/1978 | Gray et al. . | |
| 4,200,607 | 4/1980 | Suzuki . | |
| 4,262,044 | 4/1981 | Kuczma, Jr. . | |
| 4,581,260 | 4/1986 | Mawla . | |
| 4,594,273 | 6/1986 | Doss et al. | 427/443.1 |
| 4,692,346 | 9/1987 | McBride et al. . | |
| 5,054,519 | 10/1991 | Berman | 137/563 |
| 5,217,536 | 6/1993 | Matsumura et al. . | |
| 5,393,347 | 2/1995 | Miranda . | |

*Primary Examiner*—Katherine A. Bareford
*Attorney, Agent, or Firm*—Skjerven, Morrill, MacPherson, Franklin & Friel, LLP.; Ken J. Koestner

[57] ABSTRACT

An electroless plating apparatus heats a plating bath solution with precise uniformity and avoids localized high temperatures within the bath. The electroless plating apparatus achieves this performance using two solution tanks included an inner tank nested inside an outer tank. A distributed heating element encases a plurality of surfaces of the outer tank, which contains an ethylene glycol solution. The inner tank contains a plating bath solution. A substrate is placed inside the inner tank for plating. Each of the outer tank and the inner tank include a device for evenly distributing the applied heat. In one embodiment, the outer tank heat distributing device is a pump which mixes the ethylene glycol solution. The inner tank heat distributing device is a pump which recirculates plating bath solution, applying returning solution via a sparger.

23 Claims, 4 Drawing Sheets

ELECTROLESS PLATING METHOD

The present application is a division of application Ser. No. 08/546,389, filed Oct. 20, 1995, now U.S. Pat. No. 5,938,845.

FIELD OF INVENTION

The present invention relates to an apparatus and method for autocatalytic plating of metallic films on substrates. More specifically, the invention relates to an improved apparatus and method which substantially increases the uniformity of film deposition on the substrate.

BACKGROUND OF THE INVENTION

Electroless plating refers to chemical deposition on a receptive surface of an adherent metal coating, for example a nickel coating, in the absence of an external electrical source. Electroless plating or deposition is also called autocatalytic plating, thereby referring to deposition in which a chemical reducing agent in solution is applied to reduce metallic ions to a metal. This metal is deposited on a suitable substrate. The plating takes place only on catalytic surfaces rather than throughout the solution. The catalyst is initially the substrate and, subsequently, the metal initially deposited on the substrate.

One apparatus for electroless plating of nickel on an alumina substrate is shown in FIG. 1. This apparatus is typically used for plating hard disk drive media. A 35-gallon stainless steel plating tank 110 with a Teflon™ lining is filled with a nickel plating solution 112. The stainless steel tank 110 is positioned inside a tank 114 filled with ethylene glycol solution 116. A heating element 118 is positioned inside the tank 114 within the ethylene glycol solution 116 to heat the solution 116. Heat is conducted through the ethylene glycol solution 116 to the nickel plating solution 112.

Unfortunately, the ethylene glycol does not heat evenly throughout the ethylene glycol bath. Localized heating occurs near the heating element 118 and the region of the nickel plating solution 112. For this reason, when plating is conducted in the nickel plating bath, resulting plated layers tend to be thicker near the heating element 118. This electroless plating arrangement only controls temperature of the plating solution 112 to within 3° C. and local temperature variations of plating solution 112 of about this magnitude typically exist. Temperature of the plating bath in the vicinity of the heating element 118 is somewhat higher than bath temperatures removed from the heating element 118 so that the metal thickness of a substrate portion nearest the heating element 118 is significantly greater. The plating rate varies as a function of temperature so that these local variations in temperature lead to substantially varying metal layer thicknesses.

In the plating of hard disk drive media, variations in plating rate and resulting local variations in metal thickness are tolerated since the nickel metal layer is subsequently lapped or machined to a desired thickness.

Standards of electroless plating of other objects are more stringent. One example of a device having strict standards for electroless plating thickness is a thin film magnetic head gap. In magnetic recording, a magnetic media is moved at a uniform speed past poles of an electromagnet and is longitudinally magnetized. Variations in the current supplying the electromagnet produces corresponding variations in magnetization. During reproduction, the process is reversed. The magnetic media is fed past an electromagnet—a replay head—and variations in magnetization induce currents in magnetic coils corresponding to the original magnetizing currents. The electromagnet used to record, reproduce or erase the signal is called a magnetic head, or simply head. Referring to FIG. 2, there is shown an embodiment of a magnetic head 150 including magnetic pole pieces 152 and 154 wound with a coil (not shown). A separation between the pole pieces 152 and 154 is called a gap 156 with the distance between the pole pieces 152 and 154 being called a gap length. A small gap length produces a sharp record and, therefore, a more faithful reproduction. A thin film magnetic head 150 is formed by electroless plating of a thin film on the vertical sidewalls 158 of the gap 156.

The thin film head gap 156 is plated on vertical sidewalls 158 rather than deposited on a flat, horizontal surface. An electroless plating apparatus for plating the gaps of thin film heads must perform to very strict standards with respect to deposition thickness and several other parameters. Heights of various layers must be very precisely controlled. Failure to achieve these standards, even to a slight degree, typically results in unacceptable quality of the heads. The autocatalytic process of electroless plating, in which plating takes place on the catalytic surface of deposited metal, is very sensitive to variations in temperature in the plating bath. These conditions produce an unsuitable metal film layer with a film of nonuniform thickness.

The described electroless plating system is unsuitable for plating thin metals to rigorous standards of thickness uniformity required for fabrication of a thin film head gap.

What is needed is an apparatus and method for plating a thin-film head gap which provides a precisely uniform temperature throughout the plating bath and avoids localized heating within the bath.

SUMMARY OF THE INVENTION

In accordance with the present invention, an electroless plating apparatus heats a plating bath solution with precise uniformity and avoids localized high temperatures within the bath. The electroless plating apparatus achieves this performance using two solution tanks included an inner tank nested inside an outer tank. A distributed heating element encases a plurality of surfaces of the outer tank, which contains an ethylene glycol solution. The inner tank contains a plating bath solution. A substrate is placed inside the inner tank for plating. Each of the outer tank and the inner tank include a device for evenly distributing the applied heat. In one embodiment, the outer tank heat distributing device is a pump which mixes the ethylene glycol solution. The inner tank heat distributing device is a pump which recirculates plating bath solution, applying returning solution via a sparger.

In accordance with an aspect of the present invention, an electroless plating apparatus substantially eliminates temperature differentials in an electroless plating bath by applying heating element uniformly to a tank containing ethylene glycol. Temperature differentials in the ethylene glycol solution are further eliminated by agitating the solution using a pump. A plating bath tank containing a plating bath solution is immersed in the uniform-temperature ethylene glycol solution. The plating bath solution is agitated using a pump for recirculating the plating bath solution and a sparger to agitate the plating bath solution, circulate plating bath solution in the vicinity of a plated substrate and evenly conduct flow of the plating bath solution so that fresh solution is uniformly distributed.

In accordance with one embodiment of the present invention, an apparatus for electroless plating of a film of nickel-phosphorous alloy on a substrate includes a solution, such as ethylene glycol, having a boiling point higher than the boiling point of water contained within an outer tank. The apparatus also includes a plating bath solution including nickel ions contained within a plating bath tank located inside the outer tank. A heating element is uniformly distributed along an underside surface and sidewall surfaces of the outer tank, uniformly heating the solution in the outer tank. The apparatus also includes a solution mixing system having a pump with an inflow duct and an outflow duct in communication with the solution in the outer tank. The solution mixing system withdraws solution from and returns solution to the outer tank so that the solution is continuously mixing in the outer tank. A plating bath liquid recirculation system is also supplied which includes a pump connected to an inflow tube and an outflow tube, each connected to the solution in the plating bath tank for withdrawing plating bath solution from the plating bath tank and returning plating bath solution to the plating bath tank. A sparger is located within the plating bath tank and connected to the plating bath liquid recirculation system inflow tube for directing flow of the plating bath solution substantially uniformly over the substrate. A trough extends along a sidewall on an upper edge of the plating bath tank in position to receive overflow plating bath solution from the plating bath tank. The trough is connected to the plating bath liquid recirculation system outflow tube to withdraw plating bath solution from the plating bath tank and carry the solution to the pump.

In accordance with another embodiment of the present invention, a method of electroless plating of a film of nickel-phosphorous alloy on a substrate includes the steps of furnishing a plating bath solution including nickel ions in a plating bath tank and locating the plating bath tank in an outer tank holding a solution having a boiling point higher than the boiling point of water. The solution in the outer tank is heated to a predetermined, substantially uniform temperature using a heating element uniformly distributed along an underside surface and sidewall surfaces of the outer tank. The substrate is positioned in the plating bath solution in the plating bath tank. The method further includes the steps of continuously mixing the solution in the outer tank and continuously recirculating the plating bath solution. Flow of the plating bath solution is directed substantially uniformly over the substrate.

The electroless plating apparatus and method described herein achieve numerous advantages. One advantage is that the plating bath prevents localized heating within the bath that leads to deposition of unsuitable films. Another advantage is that the plating bath is maintained at a virtually constant temperature throughout the plating cycle, resulting in a precisely uniform film thickness. Still another advantage is that the plating bath is operated at as high a temperature as possible, rapidly forming uniform thin layers, while avoiding unacceptable properties of plated films that result from localized heating within the bath. Another advantage is that the described electroless plating apparatus and method avoid localized boiling in the bath that causes precipitation of the plating metal and results in spontaneous decomposition of chemicals in the plating bath solution.

BRIEF DESCRIPTION OF THE DRAWINGS

The features of the invention believed to be novel are specifically set forth in the appended claims. However, the invention itself, both as to its structure and method of operation, may best be understood by referring to the following description and accompanying drawings.

DETAILED DESCRIPTION

Figure 3:
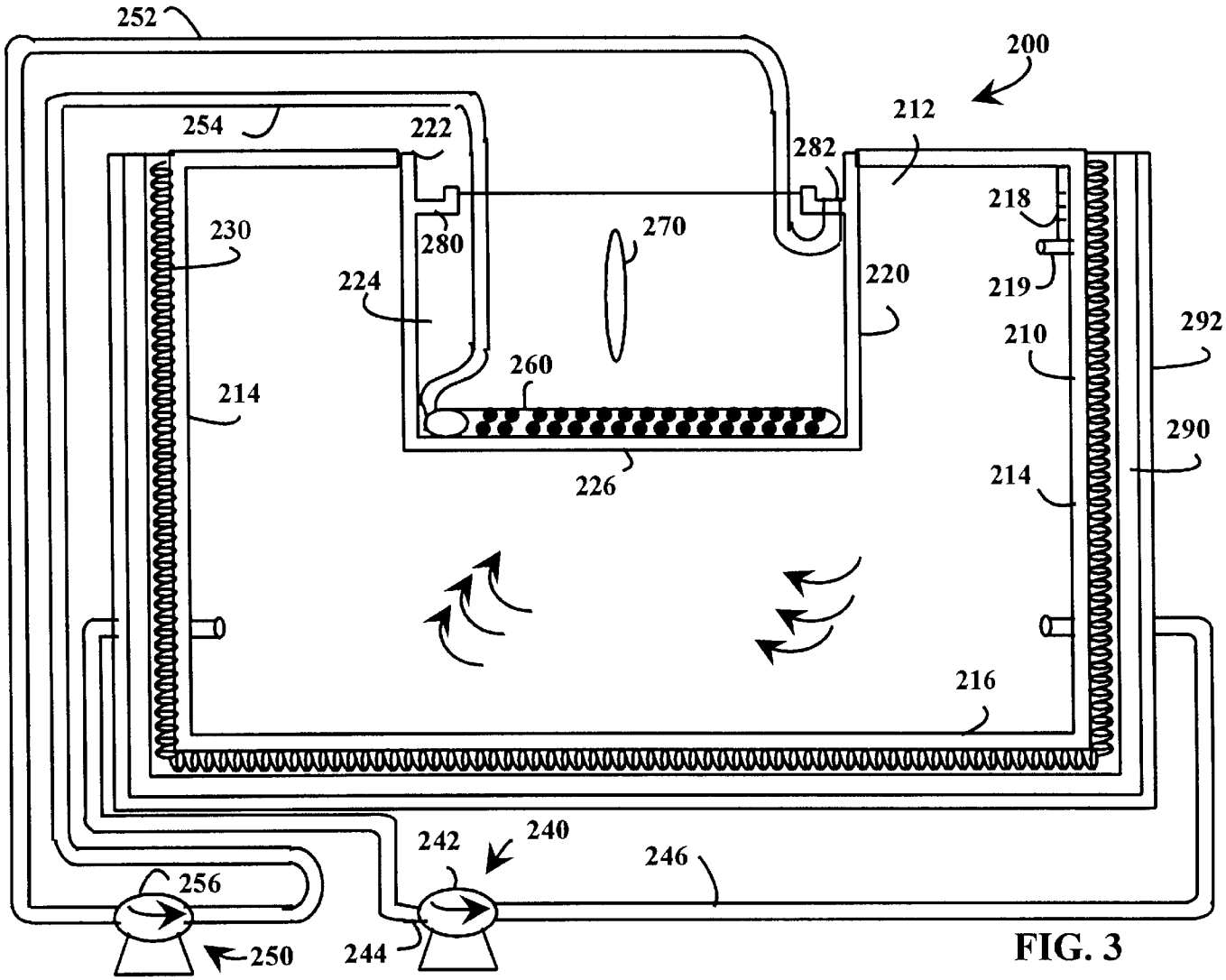
FIG. 3 is a pictorial illustration showing a side view of an electroless plating apparatus in accordance with an embodiment of the present invention.
Figure 4:
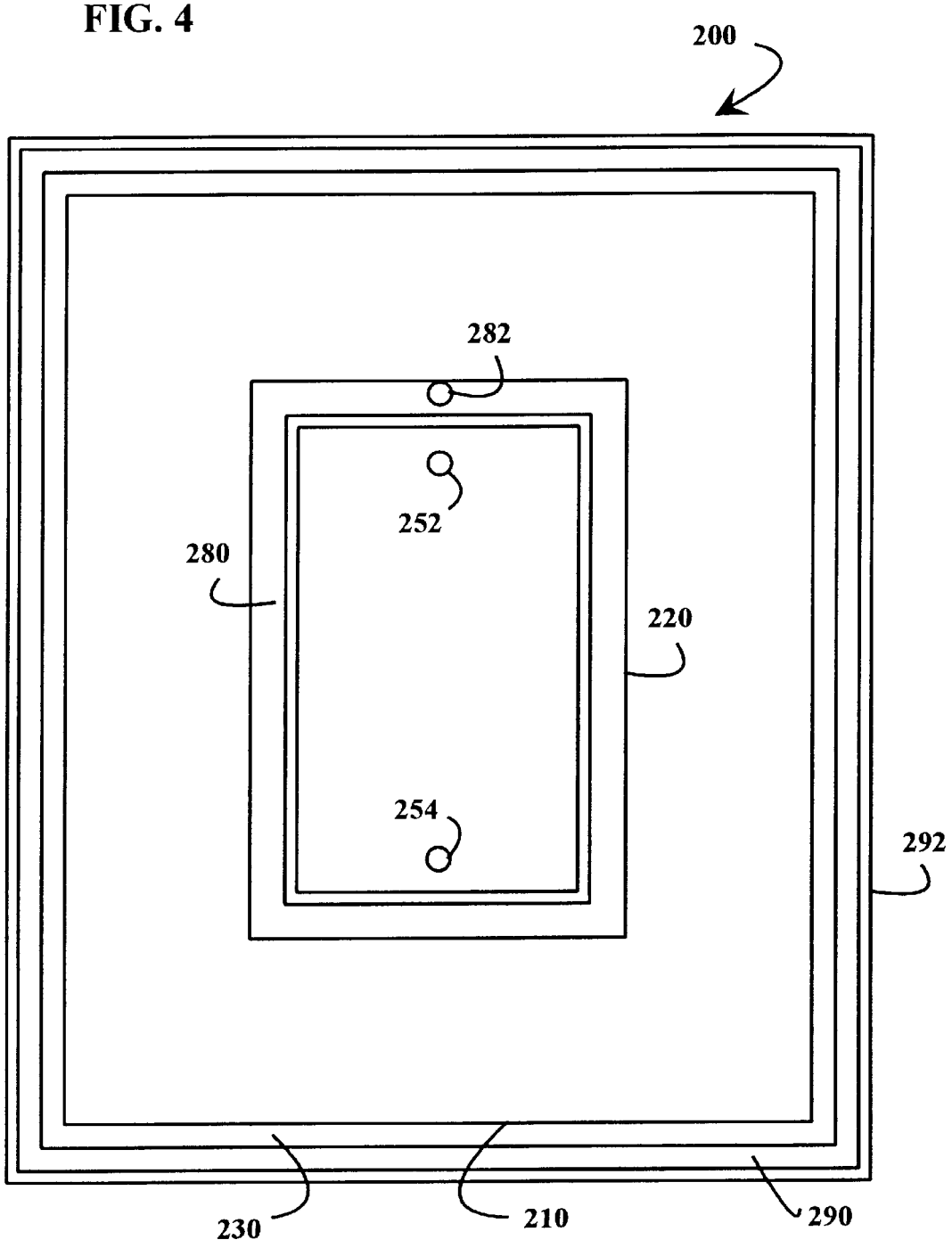
FIG. 4 is a pictorial illustration showing a top view of the electroless plating apparatus shown in FIG. 3.

Referring to FIGS. 3 and 4, an electroless plating apparatus 200 includes an outer tank 210 and an inner plating bath tank 220. The outer tank 210 is a generally rectangular seal-topped tank that holds a solution 212 having a boiling point higher than the boiling point of water such as ethylene glycol. The inner plating bath tank 220 is a generally rectangular tank which is positioned inside the outer tank 210. The plating bath tank 220 has a horizontal upper edge 222 and the plating bath tank 220 is immersed in the solution 212 nearly to the horizontal upper edge 222. The plating bath tank 220 contains a plating bath solution 224 which includes nickel ions. A heating element 230 is positioned adjacent to the outer tank 210, uniformly distributed on an outer surface of the outer tank 210. The heating element 230 is an electric stripe blanket or pad which is positioned exterior to sidewall panels 214 and an underside panel 216 of the outer tank 210 so that the solution 212 is uniformly heated.

A solution mixing system 240 is positioned exterior to the outer tank 210 to continuously mix the solution 212 throughout the outer tank 210. The mixing system 240 includes a pump 242 having an inflow duct 244 and an outflow duct 246, both in liquid communication with the solution 212, to withdraw and return solution 212 to the outer tank 210.

A plating bath liquid recirculation system 250 is positioned generally exterior to the outer tank 210 but has an inflow tube 254 and an outflow tube 252 extending to the plating bath tank 220. The plating bath liquid recirculation system 250 includes a pump 256 which is connected to the inflow tube 254 and to the outflow tube 252. The plating bath liquid recirculation system 250 withdraws plating bath solution 224 from the plating bath tank 220, removing entrapped particulate contaminants and returns plating bath solution 224 to the plating bath tank 220.

A sparger 260 is positioned inside, above and adjacent to an underside panel 226, of the plating bath tank 220. The sparger 260 is connected to the plating bath liquid recirculation system inflow tube 254 and is used to direct flow of the plating bath solution 224 substantially uniformly over a substrate 270 placed within the plating bath tank 220.

A trough 280 extends about the sidewalls along all four sides of the plating bath tank 220 and serves to collect plating bath solution 224 for redistribution to the plating bath tank 220. The trough 280 is thus located in a position to receive overflow plating bath solution 224 from the plating bath tank 220. The trough 280 is in liquid communication with the plating bath liquid recirculation system 250. The plating bath liquid recirculation system outflow tube 252 is connected to a drain hole 282 beneath the trough 280 to withdraw plating bath solution 224 from the plating bath tank 220 and to transfer the solution 224 to the recirculating pump 256.

The electroless plating apparatus 200 also includes an insulator 290 positioned exterior to the sidewall panels 214 and the underside panel 216 of the outer tank 210, also external to heating element 230. An open-topped plastic protective cover 292 has a generally rectangular shape and holds the outer tank 220, heating element 230' and insulator 290. The plastic protective cover 292 is adjacent to the insulator 290.

In the illustrative embodiment, the outer tank 210 is constructed from stainless steel so that the solution 212 is contained virtually continuously without substantial corrosion and other chemical action acting on the inner surface of the outer tank 210. The heating element 230, for example an electric stripe blanket. Heating element 230 is a resistive-type heating element which is disposed against the underside and outer walls of the outer tank 210.

The solution 212 which is employed is generally a solution including ethylene glycol. Ethylene glycol is typically utilized to elevate the boiling point of solution 212, thereby preventing localized boiling in the solution 212. Substances other than ethylene glycol, which also do not alter reactivity of the plating bath solution 224 or produce other deleterious effects, may be used. These substances do not ionize to alter the reactivity of the plating bath solution 224 or to alter the effect of complexing agents that are added to the plating bath solution 224. For example, substances such as other glycols, glucose or sucrose also function to elevate the boiling point of the solution 212 without adverse side effects. In some embodiments of the method, the amount of ethylene glycol added is selected so that the boiling point of the solution 212 is substantially the same as the desired operating temperature of the plating bath solution 224. By significantly elevating the boiling point of the solution 212, localized boiling and localized heating, either of which result in variations in deposition rate in the bath. Variations in deposition rate, in turn, causes nonuniformity in plating thickness.

The solution mixing system 240 mixes the solution 212 so that temperature differentials at different levels in the outer tank 210 are substantially eliminated, resulting in a highly uniform temperature applied to the plating bath solution 224.

The uniform, distributed heating element 230 and the solution mixing system 240 act in combination so that the solution 212 furnishes a highly uniform heat transfer to the plating bath solution 224.

The outer tank 210, solution 212, plating bath tank 220 and plating bath solution 224 are supported by protective cover 292, typically a heat resistant, plastic rectangular casing. The outer tank 210 extends downward into the protective cover 292 and is proportioned smaller than the protective cover 292 so that the heating element 230 and insulator 290 fit in the space between the outer tank 210 and protective cover 292. The insulator 290 is a suitable thermal insulation material to maintain a high temperature of the solution 212 within the outer tank 210.

A solution level indicator 218 is mounted on a sidewall near a horizontal upper edge of the outer tank 210 so that the amount of solution 212 in the outer tank 210 is maintained at a suitable level. A filling inlet 219 on a sidewall near a horizontal upper edge of the outer tank 210 allows filling of solution 212 into the outer tank 210.

The illustrative plating bath tank 220 is a four gallon quartz tank which holds the plating bath solution 224 and immersed into the solution 212 in the outer tank 210 so that the solution 212 in the outer tank 210 substantially surrounds the sidewalls and underside of the plating bath tank 220.

A typical suitable plating bath for electroless plating of nickel-phosphorus alloys includes nickel ions, a reducing agent such as sodium hypophosphate ($Na_2H_2PO_2$), a complexing agent to maintain the nickel in solution and a bath stabilizer. In one embodiment, the plating bath solution 224 is a nickel-phosphorus solution which is specifically formulated with stabilizers and buffers to furnish a smooth, nonmagnetic, high phosphorus nickel coating on ferrous, nonferrous and other nonconductive substrates. Deposit properties include a phosphorus content of 10.5–13 percent by weight, electrical resistivity of 70–100 microohm-cm, a melting point of 880° C. and a density of 7.75 g/CC. The phosphorus nickel coating is nonmagnetic. The nickel-phosphorus solution includes a highly purified nickel sulfate ($NiSO_4$) source at a concentration of 6% by volume, $NaH_2PO_2H_2O$ at a concentration of 12% by volume and deionized water for the remaining 82% by volume. The solution is made by filling the plating bath tank 220 half full with deionized water, adding the nickel sulfate and $NaH_2PO_2H_2O$, and then filling the tank 220 to a working level with deionized water. The solution is then heated to 87° F. The nickel level is tested and adjusted and the pH is adjusted to 4.8 or another selected level. The solution includes suitable complexing and stabilizing agents. The pH of the plating bath solution typically ranges from approximately 4.4 to 5.2. Nickel plating is accomplished by heating the plating bath solution 224 to the temperature of 87° F. and submersing the substrate 270 into the plating bath solution 224.

The plating bath solution 224 fills the plating bath tank 220 to the level of the trough 280 with excess solution 224 being drawn off by the plating bath liquid recirculation system 250 to keep the plating bath solution 224 circulating without any air pockets in the flow. Similarly, the plating bath liquid recirculation system 250 recharges the plating bath solution 224 by applying a flow of solution 224 to the tank 220 via the inflow tube 254 connected to the sparger 260. The inflow of solution 224 is controlled by an operator or by automatic controls using a flow control valve (not shown) for increasing the inflow if the recirculation flow rate is increased.

Figure 1:
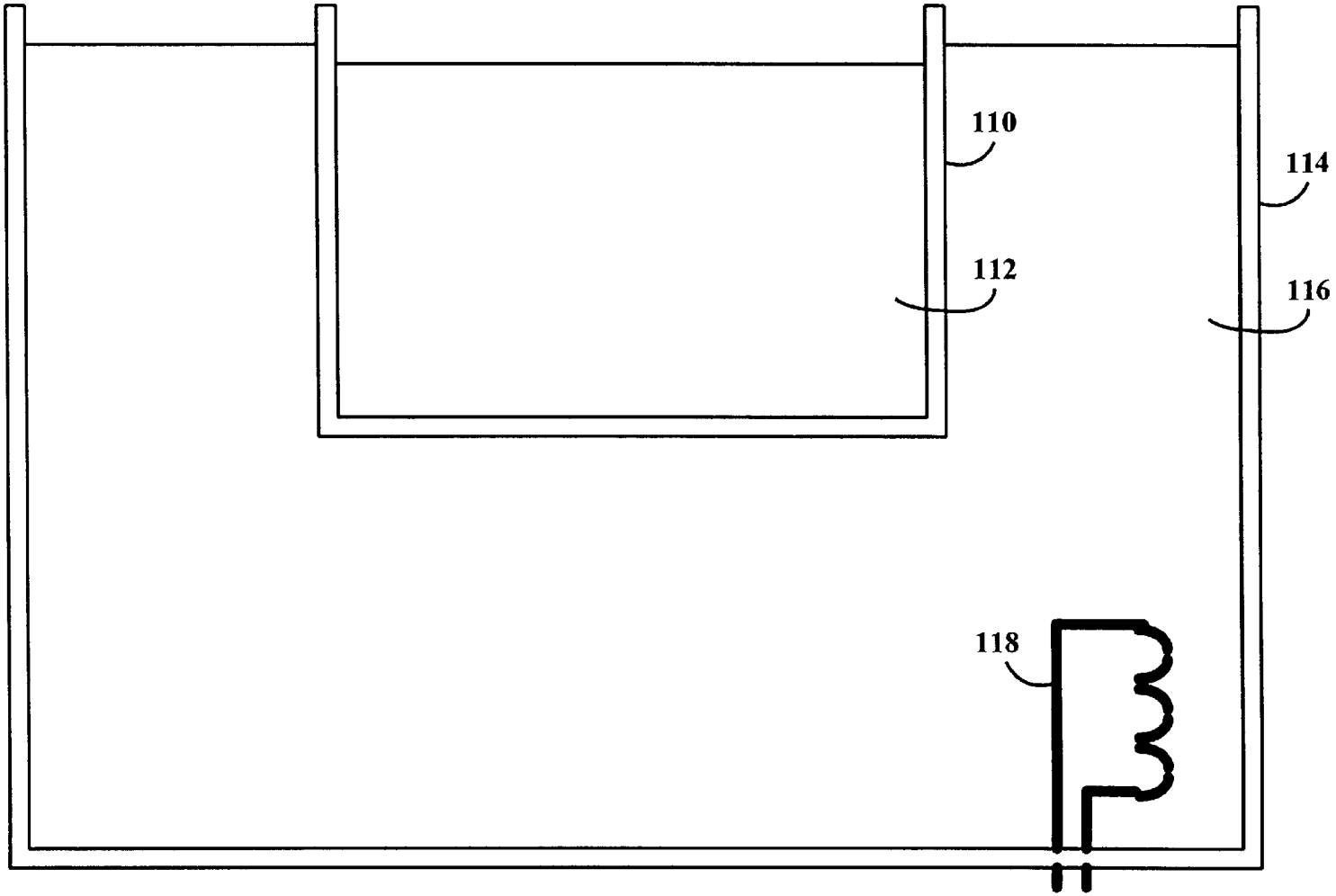
PRIOR ART FIG. 1
FIG. 1 is an illustration of an electroless plating apparatus, labelled prior art, which is typically used for plating hard disk drive media.
Figure 2:
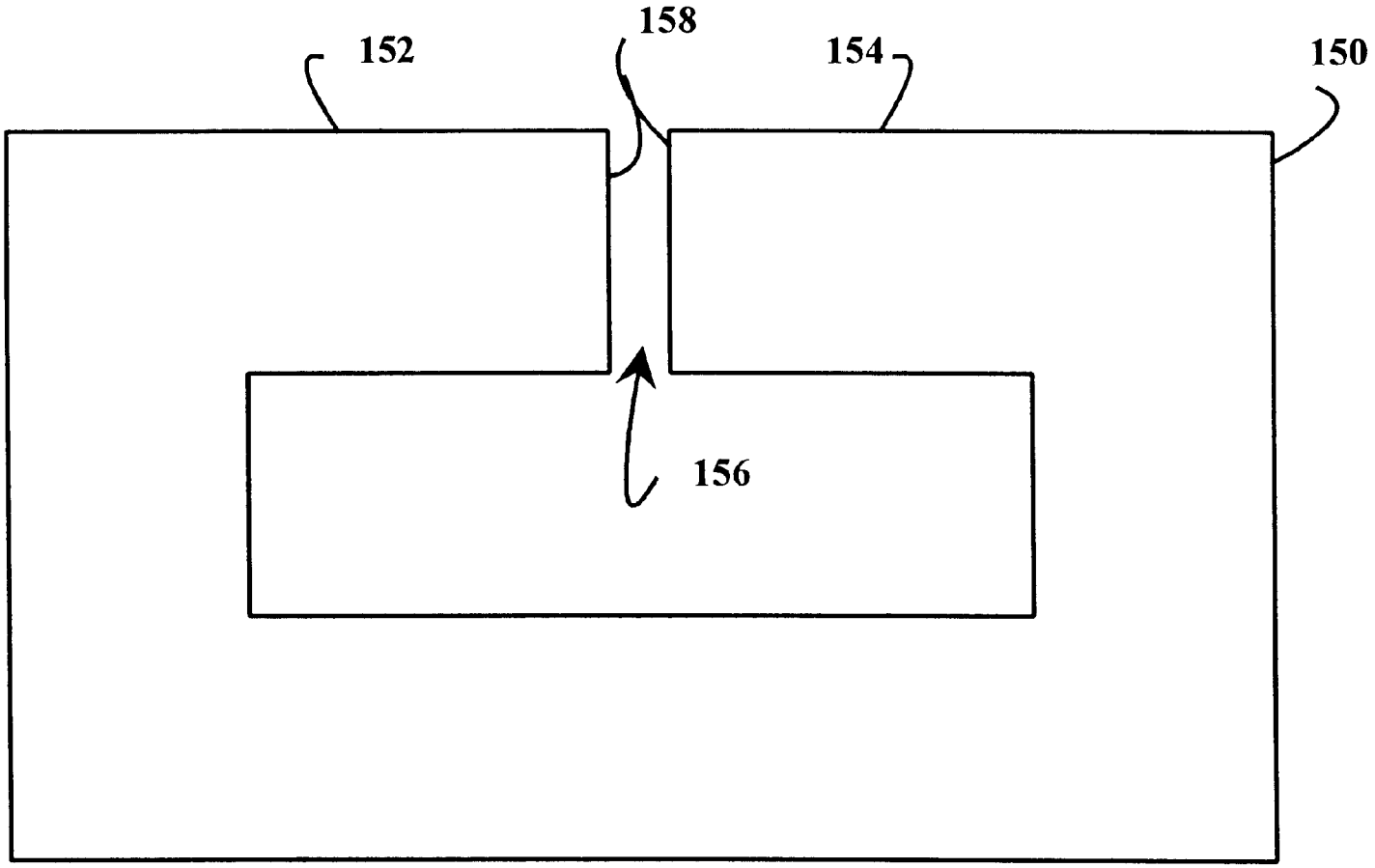
FIG. 2 is a pictorial view showing an example of a thin film head having a head gap that is plated using an electroless plating apparatus.

The substrate 270 is typically an alumina workpiece fabricated with one of the two top pole pieces of the thin film head devices. The gap material is plated onto the vertical side wall of the top pole piece 152 shown in FIG. 2. The other top pole pieces 154 is subsequently fabricated. A gap length in a range from 3800 Å to 4200 Å is suitable for a read head. A gap length in a range from 6650 Å to 7350 Å is suitable for a write head. The thin nickel phosphorous layer is nonmagnetic. The nickel phosphorous layer forms and holds an exposed vertical flat surface. The nickel phosphorous layer forms a gap of the planar thin film magnetic head.

The sparger 260 serves to evenly distribute the plating bath solution, agitate the plating bath solution 224 and bubble fresh plating bath solution across the underside panel 226 of the plating bath tank 220 through the bath to "sparge" the substrate 270 surface to sweep the substrate 270 clear of unwanted chemicals and ensure continuous accessibility of the substrate 270 surface to fresh concentrations of plating metals. In addition, heating of the plating bath solution 224 also accelerates the plating deposition rate. The sparger 260 is fed by the plating bath liquid recirculation system pump 256 through inflow tube 254 which pumps the plating bath solution 224. The sparger 260 is pierced by numerous pin-hole openings, allowing plating bath solution 224 to escape and distribute in a substantially uniform manner. The pin-hole openings are essentially the same size and distributed uniformly over the sparger 260 so that the sparging process is applied evenly to the substrate 270. The arrangement of sparger 260 openings is such as to direct a forced flow of plating bath solution 224 toward the substrate 270 disposed within the plating bath tank 220. The forced flow of plating bath solution 224 from the sparger 260 generates sufficient agitation and the pin-hole openings are sufficiently uniform in size and spacing that deposition of foreign particles or hydrogen bubbles on surfaces of the substrate 270 is prevented.

The plating bath liquid recirculation system pump 256 is specified to move the plating bath solution 224 through the recirculation system 250 including the inflow tube 252 and outflow tube 254 at a moderate rate of flow.

The trough 280 extending along the four sidewalls fully around the edge 222 of the plating bath tank 220 typically inclines slightly downward to a drain hole in the trough 280. The plating bath liquid recirculation system outflow tube 252 is connected to the drain hole of the trough 280 to most suitably withdraw plating bath solution 224 from the plating bath tank 220 and transfer the solution 224 to the pump 256. The plating bath tank 220 and trough 280 are a unitized assembly formed of molded and welded plates of a chemically inert refractory material such as quartz. Specifically, quartz is inert of the plating out reaction to the electroless nickel plating solution 224. A quartz plating bath tank 220 and trough 280 is advantageous because no lining, such as a Teflon™ lining, is necessary to provide a chemically inert nature. However, quartz is a brittle material that may be unsuitable in some embodiments. For embodiments in which quartz is an unsuitable material for the plating bath tank 220, a stainless steel tank is utilized using a Teflon™ liner.

The plating bath solution 224 is heated by applying heat from the heating element 230 to the outer tank 210, conducting and distributing heat via the circulating ethylene glycol solution 212, rather than by applying the heating element 230 directly to the plating bath solution 224 or to the plating bath tank 220. This heating technique is highly advantageous to avoid localized heating within the plating bath tank 220 which causes chemical decomposition at the wall of the plating bath tank 220. While operating the plating bath at a high temperature, localized boiling within the plating bath tank 220 disrupts transport of nickel phosphorous to the substrate 270, resulting in unacceptable properties of the deposited nickel phosphorous film. Furthermore, localized boiling causes precipitation of nickel phosphorous within the bath, resulting in spontaneous decomposition of the bath. Furthermore, localized boiling or localized high temperatures are to be avoided because a boiling or high temperature region in the bath causes an undesirable higher deposition rate, causing nonuniform plating thickness across the device.

The description of certain embodiments of this invention is intended to be illustrative and not limiting. Numerous other embodiments will be apparent to those skilled in the art, all of which are included within the broad scope of this invention. For example, the electroless plating apparatus and method are described as an apparatus and method for fabricating a thin-film magnetic head gap. Other devices and components such as magnetic hard disks may also be fabricated using the described system. Also, the heating element is described as an electric stripe blanket or pad. Other highly distributed heating elements may also be used so long as the heat distribution applied to the surface of the outer tank is substantially uniform.

What is claimed is:

1. A method of electroless plating of a film of nickel-phosphorous alloy on a substrate comprising:

furnishing a plating bath solution including nickel and phosphorous ions in a plating bath tank;

positioning the plating bath tank in an outer tank holding a heating solution having a boiling point higher than the boiling point of water;

heating the heating solution in the outer tank to a predetermined, substantially uniform temperature using a heating element uniformly distributed along and exterior to an underside surface and sidewall surfaces of the outer tank; and immersing the substrate in the plating bath solution in the plating bath tank.

2. A method according to claim 1 further comprising continuously mixing the solution in the outer tank.

3. A method according to claim 1 further comprising continuously recirculating the plating bath solution.

4. A method according to claim 1 further comprising directing flow of the plating bath solution substantially uniformly over the substrate.

5. A method according to claim 1 wherein the solution having a boiling point higher than the boiling point of water in the outer tank is an ethylene glycol solution.

6. A method of electroless plating of a film of nickel-phosphorous alloy on a substrate comprising:

completely immersing the substrate into a plating bath tank containing a plating bath solution;

heating the plating bath solution to a precisely uniform temperature and avoiding localized high temperatures in the vicinity of the substrate, the heating and avoiding step including:

applying a heating element uniformly exterior to sidewall panels and exterior to an underside panel of an outer tank containing a solution having a boiling point higher than the boiling point of water;

uniformly mixing the solution having a boiling point higher than the boiling point of water; and immersing sidewall panels and an underside panel of the plating bath tank into the outer tank.

7. A method for electroless plating of a film of ionic alloy on a substrate comprising:

continuously mixing a solution having a boiling point higher than the boiling point of water in an outer tank containing the solution, the outer tank having an underside surface and sidewall surfaces;

suspending a plating bath tank containing a plating bath ionic solution within the outer tank;

recirculating the plating bath ionic solution in the plating bath tank so that the concentration of the plating bath ionic solution and the plating bath solution temperature are uniform;

uniformly heating the underside surface and the sidewall surfaces of the outer tank using a heating element uniformly distributed along and exterior to the underside surface and sidewall surfaces of the outer tank so that the continuously mixed solution in the outer tank has a uniform temperature distribution and the recirculated plating bath ionic solution has a uniform temperature distribution; and uniformly electroless-plating the film onto the substrate via the uniform temperature distribution and the uniform plating bath ionic solution concentration.

8. A method according to claim 7 wherein the ionic solution is a nickel-phosphorus solution.

9. A method according to claim 7 further comprising:

recirculating the plating bath ionic solution in the plating bath tank using a sparger located within the plating bath tank and directing flow of the plating bath solution substantially uniformly over the substrate.

10. A method according to claim 7 wherein:

the solution having a boiling point higher than the boiling point of water in the outer tank is an ethylene glycol solution.

11. A method according to claim 7 wherein:

the substrate is selected from among ferrous substrates and nonferrous nonconductive substrates.

12. A method according to claim 7 wherein:

the substrate is an alumina substrate.

13. A method of electroless plating a substrate comprising:

immersing the substrate in an inner solution tank containing a plating bath solution including metallic alloy ions;

suspending the inner solution tank within an outer solution tank having a plurality of surfaces and containing a solution having a boiling point higher than the boiling point of water;

uniformly heating of the plurality of surfaces of the outer solution tank using a heating element uniformly distributed along and exterior to the plurality of surfaces of the outer solution tank;

continuously mixing the solution having a boiling point higher than the boiling point of water in the outer solution tank; and continuously mixing the plating bath solution in the inner solution tank, the continuous mixing of the solutions in the outer solution tank and the inner solution tank uniformly distributing the temperature of the solutions in the outer solution tank and the inner solution tank, and uniformly distributing the metallic alloy ions in the plating bath solution so that uniform plating onto the substrate occurs.

14. A method according to claim 13 wherein the ionic solution is a nickel-phosphorus solution.

15. A method according to claim 13 wherein:

the solution having a boiling point higher than the boiling point of water in the outer tank is an ethylene glycol solution.

16. A method according to claim 13 wherein:

the substrate is selected from among ferrous substrates and nonferrous nonconductive substrates.

17. A method according to claim 13 wherein:

the substrate is an alumina substrate.

18. A method for electroless plating of a substrate comprising:

supplying a solution having a boiling point higher than the boiling point of water in an outer tank;

immersing a plating bath tank in the solution within the outer tank;

supplying a plating bath solution including metal ions to the plating bath tank;

recirculating the plating bath solution in the plating bath tank by withdrawing the plating bath solution from the plating bath tank and returning the plating bath solution to the plating bath tank;

heating the solution in the outer tank via a heating element distributed uniformly along and exterior to underside and sidewall surfaces of the outer tank;

continuously mixing the solution in the outer tank; and immersing a substrate in the plating bath solution within the plating bath tank.

19. A method according to claim 18 further comprising:

directing flow of the plating bath solution substantially uniformly over the substrate.

20. A method according to claim 18 wherein the solution in the outer tank is an ethylene glycol solution.

21. A method according to claim 18 wherein the metal ions in the plating bath solution are nickel ions and phosphorus ions.

22. A method according to claim 18 wherein:

the substrate is selected from among ferrous substrates and nonferrous nonconductive substrates.

23. A method according to claim 18 wherein:

the substrate is an alumina substrate.

* * * * *

UNITED STATES PATENT AND TRADEMARK OFFICE

CERTIFICATE OF CORRECTION

PATENT NO. : 6,093,453
DATED : July 25, 2000
INVENTOR(S) : Ang

It is certified that error appears in the above-identified patent and that said Letters Patent is hereby corrected as shown below:

Column 9,
Line 19, delete "of" first occurrence.

Signed and Sealed this

Twenty-sixth Day of November, 2002

*Attest:*

*Attesting Officer*

JAMES E. ROGAN
*Director of the United States Patent and Trademark Office*